United States Patent [19]

Bondpers et al.

[11] 4,150,475

[45] Apr. 24, 1979

[54] METHOD OF MANUFACTURING A REINFORCING CAGE FOR A CONCRETE POST, AND A FIXTURE FOR CARRYING OUT THE METHOD

[75] Inventors: Per-Erik Bondpers, Växjö; Kjell-Äke Wickström, Strängnäs, both of Sweden

[73] Assignee: A-Betong AB, Växjö, Sweden

[21] Appl. No.: 875,725

[22] Filed: Feb. 7, 1978

[30] Foreign Application Priority Data

Feb. 7, 1977 [SE] Sweden ..... 7701334

[51] Int. Cl.[2] ..... B23P 21/00; E04B 1/30

[52] U.S. Cl. ..... 29/469; 52/741; 29/155 C

[58] Field of Search ..... 29/469, 463, 155 C, 29/428; 140/111; 52/745, 741

[56] References Cited

U.S. PATENT DOCUMENTS

| | | | |
|---|---|---|---|
| 2,832,131 | 4/1958 | Leitner et al. | 27/469 X |
| 3,874,062 | 4/1975 | Muto et al. | 29/155 C X |

*Primary Examiner*—Milton S. Mehr

*Attorney, Agent, or Firm*—Sughrue, Rothwell, Mion, Zinn and Macpeak

[57] ABSTRACT

In a method of manufacturing a reinforcing unit in the form of a cage or basket for a concrete post, the reinforcing rods are placed on pivotable, concave support arms in a fixture so as to form two separate concave parts of the finished unit. Support rings are then secured along said parts perpendicularly to the axis of the finished unit. The parts are brought together, and the support rings of one part are joined to the reinforcing rods of a corresponding part. The said parts are preferably brought together by swinging the support arms upwards in a manner such that the axis of the cage falls in a vertical longitudinal medium plane through the fixture. The support arms are pivoted downwards, whereupon a helical reinforcing element is threaded onto the unit from one end thereof and joined thereto.

In the method use is made of a plurality of fixture units each comprising a frame, and two concave support arms pivotally arranged around horizontal shafts.

12 Claims, 5 Drawing Figures

1
2
3
4
5
6
10
11
11a
11b
12
13
14
14d
15
15d
20
23
25
31
35
36
IV

METHOD OF MANUFACTURING A REINFORCING CAGE FOR A CONCRETE POST, AND A FIXTURE FOR CARRYING OUT THE METHOD

When manufacturing reinforcing units in the form of cages or baskets for reinforcing concrete posts, which reinforcing units comprise rectalinear rods held by encircling supports, closed supports are, for example, suspended on hangers and the reinforcing rods inserted in and tied securely to the supports. One method has been to attach open supports on suspended reinforcing rods. Another method is one in which the reinforcing unit is assembled on a table or on the floor by successive rolling of the reinforcing unit.

All of these methods are time consuming, particularly in the case of manufacturing reinforcing cages for long concrete posts, and do not provide for accuracy in the finished reinforcing cage, which cannot be accepted in the case of concrete posts having a thin wall, when seen in cross section.

The described methods also render access difficult, particularly in the case of long and narrow units, particularly when the reinforcing rods are positioned close together. Thus, the manufacture of such a reinforcing unit takes considerable time, which results in high costs.

The present invention provides a considerably simpler method of manufacturing reinforcing units in the form of cages or baskets of the aforementioned type.

The invention is characterized in that reinforcing rods are placed on pivotable, concave support arms in a fixture, in a manner such that the rods form two separate concave parts which together form the reinforcing cage; that support rings are secured along said parts perpendicularly to the axis of the finished reinforcing cage; that the parts are brought together; and that the support rings of one part are joined with the reinforcing rods of the opposite part.

When applying the method of the invention it is preferred that the parts comprise halves of the finished cage, and that the support rings are arranged alternately at approximately equal distances in the two halves.

By arranging the reinforcing rods in the aforementioned manner, in the form of two parts (halves), ready access can be had during the reinforcing work. In this way the work of the workman is greatly facilitated. Furthermore, the ease of access enables the rods to be better secured.

The arrangement of the support rings provides a more stable reinforcing cage. Since the reinforcing rods can be fixed in position in the concave support arms, the greatest possible accuracy is obtained with respect to the position of said rods, thereby providing an accurately produced reinforcing cage. The division of the cage into two parts or halves also affords the advantage whereby the reinforcing rods can be readily placed in the centre of the fixture where they are easily accessible, said rods being either lifted or drawn horizontally into said centre. Thus, the rod can be moved through a short distance to their respective positions in the concave support arms without causing heavy work.

Moreover, since rods of different dimension and length are used in one and the same reinforcing unit, the correct rod can more readily be arranged in the correct place, e.g. by giving a specific rod and its intended position in the fixture the same colour marking.

In a preferred embodiment of the invention the parts of the cage are joined together by swinging the support arms upwardly in a manner such that the axis of the reinforcing cage lies in a vertical, longitudinal mean plane through the fixture.

Alternatively, only the support arms for one part of the basket may be pivotable, said one part being arranged to be pivoted through approximately 180° into position on the other part. In this case, however, high requirements are placed on the attachment of the reinforcing rods to the support arms. Further, such a method results in difficulties when a helical reinforcing element is later placed on the reinforcing cage.

When, as is preferred, both support arms are arranged to be swung up towards each other, joining of the two parts together is greatly facilitated. Preferably the two parts are tied together. The two parts (halves) are readily accessible in the aforementioned upwardly swung position.

When carrying out the method, it is preferred that the reinforcing cage is supported by vertically movable support means associated with the fixture and arranged in spaced apart relationship, said support means being lowered one at a time out of engagement with the reinforcing cage when the helical reinforcing element is threaded thereonto.

The work involved with applying the helical reinforcing element and its tying to the cage, which work is extraordinarily complicated when applying previously known methods, can, in this way, be greatly assisted and simplified.

The invention also relates to a fixture comprising a plurality of spaced apart units for carrying out the aforementioned method.

A fixture unit is substantially characterized by a frame, two concave support arms which are pivotable about parallel, horizontal shafts; means located in the arms, e.g. recesses, for receiving reinforcing rods; means for fixing the arms extending in opposite directions in a substantially horizontal position; and means for fixing the arms when these are brought together in a preferably substantially vertical position.

A plurality of such units sequentially arranged in spaced apart relationship results in a fixture of low cost, thereby affording the aforementioned advantages. The manufacture of the reinforcing cage having a length of 20 to 25 meters, which when applying conventional manufacturing methods can be expected to take about 20 man hours, will only take about 4 to 5 man hours when using a fixture according to the invention. In addition to this substantial saving in cost, there is also obtained the aforementioned increase in precision of the finished reinforcing cage.

In practice it is preferred that the support arms are replaceably arranged in the frame, so that said arms can be replaced by arms of different shapes and form.

In this way, reinforcing cages of different types and shapes can be manufactured by means of one and the same fixture. It is thus possible, for example, to manufacture conically tapering reinforcing cages, the adjecently lying fixture units exhibiting a concave shape with a radius of curvature which decreses axially. Alternatively, all fixture units can carry identical support arms for manufacturing cylindrical reinforcing cages for concrete posts with corresponding profile design. Other types of reinforcing cages can also be manufactured, depending upon the design of the support arms.

In order to render the task of placing the helical reinforcing element in position more easy, it is preferred that the support arms can be swung downwardly to a vertically downwardly extended position. In this way, the support arms can be moved out of the way so as not to present an obstacle to the threading of the helical reinforcing element.

Conveniently the frame also has a centrally arranged support means for the reinforcing rods and for the reinforcing cage, respectively. These support means are suitably movable in a vertical direction and actuated by a cylinder-piston arrangement.

In a preferred embodiment, the support means comprises rollers having horizontal shafts. Such rollers facilitate the positioning of the reinforcing rods on the figure, when the work of manufacturing a cage is to commence.

The central support means on the fixture units may suitably comprise a cradle or a stirrup-shaped element of concave form, which is located at a level above the support means and is removably arranged.

When the reinforcing rods shall be placed in position, the support means is removed and is then later returned to its initial position when the parts of the reinforcing cage have been moved together by the support arms, in order to support the reinforcing cage. As above mentioned, the support arms can then be dropped or swung down to their vertically extending position.

When the helical reinforcing element is then placed in position, the support means are lowered one after the other by means of the piston-cylinder arrangement, the reinforcing cage being supported by the support means on the fixture units located on either side of that unit which has been lowered to permit the helical reinforcing element to pass. The helical reinforcing element can be progressively threaded on the reinforcing rods by lowering the support means one after the other beginning from one end of the reinforcing cage, in the aforementioned manner.

In one further embodiment of the fixture units according to the invention, those concave support arms of the units which extend in the same direction are interconnected, e.g. by rods extending along the underside of the arms, and are actuated by a lifting means so that they can be swung up in unison by the support arms thus joined to a vertical position. The rods of a reinforcing cage having a length of 20 to 25 meters may weigh as much as approximately 100 kg, of which weight half is represented by each half part of the cage, and it will thus be understood that the work involved is made much easier by the fact that the support arms carrying the rod can be swung up mechanically.

So that the invention will be more readily understood and further features thereof made apparent, an exemplary embodiment of the invention will now be described in more detail with reference to the accompanying schematic drawing.

Corresponding elements have been given the same reference numerals in the different figures.

Figure 1:
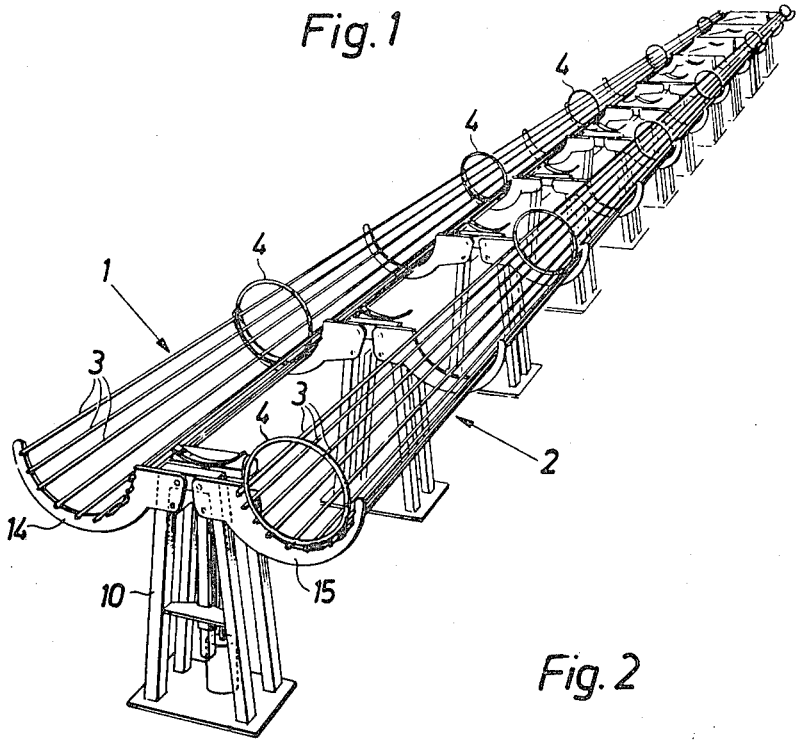
FIG. 1 is a perspective view of a fixture which comprises a plurality of units and which is intended for the manufacture of a conically tapering reinforcing cage for a concrete post.

Thus, the reference 1 identifies one half of a reinforcing cage being manufactured in a fixture. The reference numeral 2 identifies the other half of the reinforcing cage. The reference 3 identifies the reinforcing rods of which the cage comprises, while the reference 4 identifies the spaced-apart support rings of respective halves.

Figures 3, 4, 5:
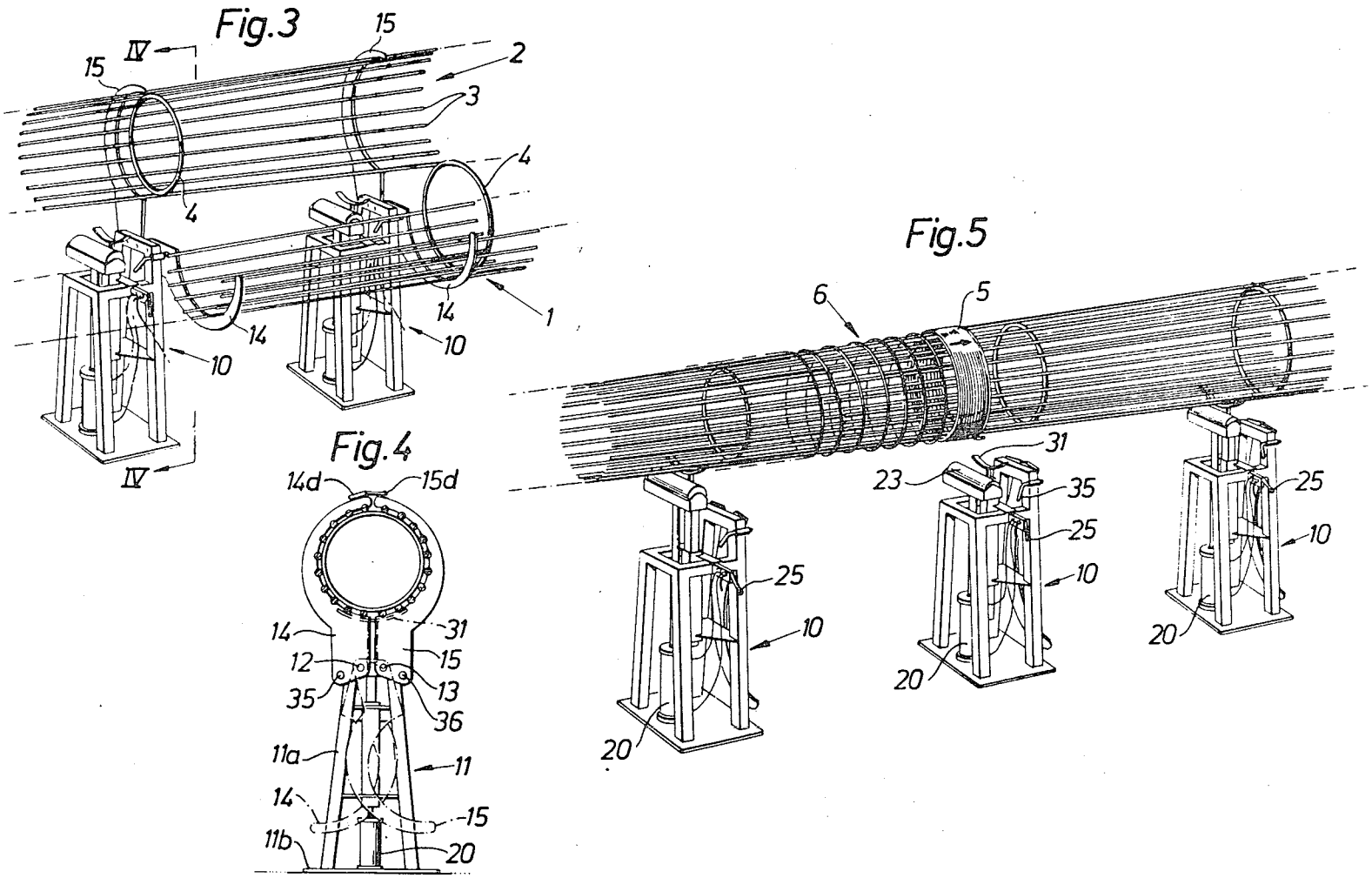
FIG. 3 is a perspective view of two units of the fixture according to FIG. 1 with the support arms of one side and illustrates one half of a reinforcing cage swung up to a vertical position.
FIG. 4 is a sectional view taken on the line IV-IV in FIG. 3 subsequent to swinging the other half of the reinforcing cage, through the support arms of said other side, to a vertical position.
FIG. 5 is a perspective view of three units of the fixture shown in FIG. 1 and a reinforcing cage on which a helical reinforcing element is being threaded.

FIG. 1 illustrates how the reinforcing rods 3 are arranged on pivotable, concave support arms 14 and 15, respectively, in a manner such as to form the two separated, concave parts 1 and 2 of the finished cage. The fixture comprises eleven units 10. FIGS. 3 and 4 illustrate how the arms 14 and 15 of the fixture are swung to a vertical position, the parts 1 and 2 being brought together in this position. The support rings 4 of the different parts are then tied or lashed to the reinforcing rods of an opposing part. The axis of the reinforcing cage is thus located in a vertical, longitudinal mean plane through the fixture.

FIG. 4 illustrates the support arms 14, 15 in their downwardly swung position, and FIG. 5 illustrates a helical reinforcing element 5 being threaded onto the cage. Subsequent to being placed in position, the helical reinforcing element is tied or lashed to the finished cage.

The reinforcing rods 3 are normally tied or lashed to the support rings 4, although in certain instances the rods may be welded to said rings. The support ring 4 located at the fixed end of the cage is normally always welded to the rods 3.

Figure 2:
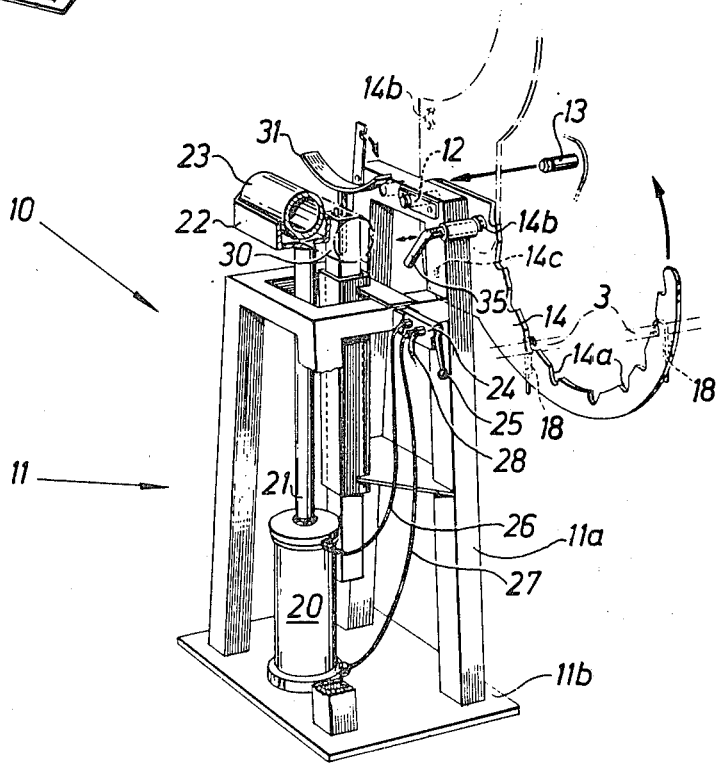
FIG. 2 is a perspective view of a unit belonging to the fixture shown in FIG. 1.

FIG. 2 illustrates in larger scale one of the units 10 of the fixture. The units 10 comprise the frame 11 having legs **11*a* and a lower support plate 11*b*. Each fixture carries two concave support arms 14 and 15 which are pivotable about parallel horizontal shafts 12 and 13, respectively. Arranged in uniform spaced relationship in the arms are recesses 14*a* and 15*a*, respectively, for receiving reinforcing rods 3. The arms also carry locking means 18**.

In FIG. 2 there is illustrated in broken lines a shaft 13 in a withdrawn position, thereby indicating that the support arms 14 and 15 are exhangeably arranged, i.e. said arms can be replaced by arms of another shape or form in the frame.

Arranged in the frame is a pneumatic cylinder 20 having a piston 21 which carries a box 22 in which there is located a rotatable carrying and conveying means for reinforcing rods, said means having the form of a rotatable roll 23. The box 22 is joined with a rod 30 which removably supports a support means in the form of a concave stirrup-like structure or cradle 31 for the reinforcing cage. The stirrup-like structure is located at a higher level than the upper part of the roller 23. When the roller is to be used, the stirrup-like structure is removed and replaced later when it is to be used to support the reinforcing cage.

The cylinder-piston-arrangement 20, 21 is operated by means of a device 24 having a handle 25, via feed and return lines 26 and 27, respectively. The reference 28 identifies a support line for compressed air, only part of the line being shown.

The unit illustrated in FIG. 2 is also provided with an axially displaceable and rotatable handle 35 which co-acts with a half-moon shaped recess 14*b* in the support arm 14 for fixing the same in the horizontal position illustrated in FIG. 1. The handle 35 has a peg thereon which, when the support arm 14 is lifted up to the vertical position shown in FIG. 4, engages a hole in the support arm, thereby to fix the support arm in the vertical position. FIG. 4 also illustrates a quick-acting lock for holding the two support arms together in their uplifted position. Thus, on the support arm 14 there is provided a quick-lock arrangement 14*d* arranged to co-act with a recess 15*d* on the support arm 15.

FIG. 4 also illustrates how the support arms 14, 15, after releasing the locking arrangement 14*d*, 15*d* and the handle 35, 36, can be swung to a vertically extending position, as indicated by the chain lines in said figure.

FIG. 5 illustrates how a helical reinforcing element is threaded on the cage from the narrow end thereof. The support means 31 on the outer fixture unit 10 has been moved downwardly so that the reinforcing cage only rests on corresponding support means 31 on adjacent fixture units. The helical reinforcing element 5 can in this way be readily threaded on the cage. As the helical reinforcing element is moved along the cage, successive support means 31 of consecutive fixture units are lowered.

Subsequent to placing the helical reinforcing element in position and tying said element or fixing it in some other way, the reinforcing cage 6 is ready for use.

Instead of the reinforcing rods 3 being held in recesses 14*a* by the locking means 18 located on the support arms 14, when said support arms are swung to their upward position, it is possible to provide other types of locking means (not shown) arranged to engage the support rings 4 of respective parts of the cage and thereby contribute to holding the unit 1 and 2 as a whole in the correct position during the upward swinging of said part.

Furthermore, as before-mentioned, the support arms 14 and 15 of all fixture units 10 extending in the same direction can be joined together by a rod (not shown) arranged to be actuated by a piston-cylinder-arrangement (not shown) simultaneously to swing the support arms extending to the left and to the right, respectively, of the two parts 1 and 2 of the cage upwardly.

What is claimed is:

1. A method of manufacturing a reinforcing unit in the form of a cage or basket for a concrete post, comprising the steps of placing reinforcing rods on pivotable, concave support arms in a fixture so as to form two separate, concave parts of the finished unit;

securing support rings along said parts perpendicularly to the axis of the finished unit;

bringing together the parts; and joining the support rings of one part to the reinforcing rods of the opposite part.

2. A method according to claim 1, characterised by bringing together said parts by swinging the support arms upwards in a manner such that the axis of the cage falls in a vertical longitudinal medium plane through the fixture.

3. A method according to claim 2, characterised by swinging downwards the support arms, and threading a helical reinforcing element onto the unit from one end thereof and joining it thereto.

4. A method according to claim 3, characterised by supporting the unit by vertically movable, spaced apart support means and lowering one after the other out of engagement with said unit during the positioning of said helical reinforcing element.

5. A fixture unit for manufacturing a reinforcing unit in the form of a cage or basket for a concrete post wherein said unit comprises a frame;

two concave support arms pivotally arranged around two parallel horizontal shafts;

means on said support arms, for receiving reinforcing rods;

means for fixing the support arms extending in opposite direction in a substantially horizontal first position; and means for fixing the support arms in a preferably substantially vertical second position in which they are brought together.

6. A unit according to claim 4 wherein support arms of different form are exchangeably arranged in the frame.

7. A unit according to claim 6, wherein the support arms are arranged to be pivoted downwardly to a vertical, depending position.

8. A unit according to claim 5, wherein the frame has centrally arranged support and carrying means for supporting said reinforcing rods and the reinforcing unit, respectively.

9. A unit according to claim 8, wherein the support and carrying means are vertically movable and actuated by the same cylinder-piston-arrangement.

10. A unit according to claim 9, wherein the rod support means comprise rollers having horizontal shafts.

11. A unit according to claim 8, wherein the support means has a concave shape and is located at a level above the support means for the rods and is removably arranged.

12. A fixture comprising a plurality of fixture units according to claim 5, wherein the concave support arms of all units facing in one direction are joined together and actuated by a common lifting device for simultaneous swinging the support arms to said second position.

* * * * *

UNITED STATES PATENT AND TRADEMARK OFFICE

CERTIFICATE OF CORRECTION

PATENT NO. : 4,150,475

DATED : April 24, 1979

INVENTOR(S) : Per-Erik BONDPERS et al

It is certified that error appears in the above-identified patent and that said Letters Patent are hereby corrected as shown below:

IN THE HEADING:

Foreign Application Priority Data:

delete "7701334" insert -- 7701343 --

Signed and Sealed this

*Seventeenth* Day of *July 1979*

[SEAL]

*Attest:*

*Attesting Officer*

LUTRELLE F. PARKER

*Acting Commissioner of Patents and Trademarks*